United States Patent [19]

Kondur, Jr.

[11] 4,004,671

[45] Jan. 25, 1977

[54] WIRE MATRIX PRINT HEAD

[75] Inventor: Nicholas Kondur, Jr., Riverton, Wyo.

[73] Assignee: LRC, Inc., Riverton, Wyo.

[22] Filed: Dec. 16, 1974

[21] Appl. No.: 532,870

[52] U.S. Cl. ..... 197/1 R; 101/93.05

[51] Int. Cl.[2] ..... B41J 3/05

[58] Field of Search ..... 197/1 R; 101/93.05

[56] References Cited

UNITED STATES PATENTS

| | | | |
|---|---|---|---|
| 2,129,065 | 9/1938 | Loop | 197/1 R |
| 2,928,338 | 3/1960 | Wolkenfuss | 197/1 R X |
| 3,333,667 | 8/1967 | Nordin | 197/1 R |
| 3,584,575 | 6/1971 | Distl | 197/1 R X |
| 3,592,311 | 7/1971 | Chou | 197/1 R |
| 3,627,096 | 4/1969 | Finnegan | 197/1 R |
| 3,672,482 | 6/1972 | Brumbaugh et al. | 197/1 R |
| 3,795,298 | 3/1974 | Kodis | 197/1 R |
| 3,833,105 | 9/1974 | Howard | 197/1 R |
| 3,897,865 | 8/1975 | Darwin et al. | 197/1 R |

*Primary Examiner*—Ralph T. Rader
*Attorney, Agent, or Firm*—John E. Reilly

[57] ABSTRACT

A wire matrix print head for a dot matrix printer employs a plurality of electromagnetically actuated print wires converging forwardly through a wire guide member for termination at their leading ends in confronting and adjacent relation to the print medium. The trailing ends of the print wires are mounted within electromagnetic actuators for movement in a lengthwise direction to cause their leadings ends to be driven into the print medium to form a series of even impressions or dots thereon, the print wires being displaced at equal included angles between adjacent print wires. The wires diverge in different directions along equal radii of curvature preferably corresponding to their elastic curves from their leadings ends toward the trailing ends whereby to minimize frictional surface engagement in supporting the wires for movement into the print medium under an equal degree of force to assure uniform impressions or dots in forming each character or symbol.

18 Claims, 11 Drawing Figures

WIRE MATRIX PRINT HEAD

This invention relates generally to matrix printer apparatus and more particularly relates to a novel and improved wire matrix print head for a wire printer including the wire guide body and solenoid actuator construction and arrangement with respect to the body.

BACKGROUND OF THE INVENTION

In printing characters or symbols with a matrix print head, customarily the print wires have their leading ends disposed in confronting relation to the record of print medium so that as the print head is advanced across the page selected wires are actuated to drive their leading ends into the print medium to form a series of dots which make up each character or symbol. Generally, the print wires must be actuated several times in forming each character or symbol and, since they are driven along their lengths are highly subject to wear, misalignment and uneven impressions as the print head is advanced across the page. In forming a series of closely spaced dots, the leading ends of the print wires are arranged in closely spaced relation to one another and necessarily must diverge rearwardly away from the closely spaced leading ends in order to afford sufficient spacing for insertion of the trailing end of each print wire in an actuator. Typically the actuators are of the solenoid or electromagnetic type, and the trailing end of each print wire is affixed to the armature so that when the armature is energized it will cause the print wire to advance forwardly in driving its leading end into contact with the print medium. As a result, the print wires must be of sufficient length to permit gradual divergency away from their leading ends to a point which will afford sufficient spacing between the electromagnetic actuators. It is conventional to mount or guide the print wires so as to be disposed on a radius of curvature corresponding to its elastic curve in order to minimize the support required for the print wire along its length as it is driven forwardly and away from the print medium. In the past, however, this has been done by positioning the wires in the same plane and diverging the wires rearwardly away from the leading ends at different angles with respect to the print medium, as a result of which the print wires were displaced at different angles with respect to the paper and had a tendency to make uneven impressions when actuated by their respective electromagnetic drivers. Moreover, disposition of the drivers in a single plane or line necessitated support along the substantial length of the print wire, especially of the outer print wires, to assure that the wires would remain in the desired path when driven into the print medium.

Another problem associated with wire matrix print heads has been that of maintaining the print wires in a selected guide path to most efficiently drive the wires with a minimum of wear while devising a print head which would occupy a minimum of space and be as lightweight as possible. This is especially important in smaller machine applications, such as, calculator printers of the type set forth and described in my copending application Ser. No. 527,603, filed 27 Nov, 1974 and entitled SERIAL IMPACT CALCULATOR PRINTER.

SUMMARY OF THE INVENTION

It is therefore an object of the present invention to provide for a novel and improved wire matrix print head incorporating a unique manner and means for supporting a plurality of electromagnetically actuated print wires in such a way as to minimize wear and power requirements in driving the print wires.

It is another object of the present invention to provide in a wire matrix print head assembly for a wire guide body adapted to guide a series of print wires for uniform rearward extension away from closely-spaced leading ends of the wires to rearwardly divergent trailing ends, the print wires being displaced at equal angles both with respect to one another and with respect to the print medium whereby to achieve uniformity in printing each dot formed by a print wire.

A further object of the present invention is to provide for a novel and improved, simplified and compact means for mounting print wires in a matrix print head for selective actuation of each wire in forming characters comprised of a series of dots; and wherein the wires are supported in such a way as to minimize frictional engagement and permit open support of the wires along the greater portion of their length.

A further object of the present invention is to provide in a wire matrix print head for improved guide means to support each wire on its elastic curve and with each print wire diverging rearwardly through planes located at equally displaced angles with respect to the plane of adjacent print wires whereby to permit the most compact and lightweight mounting possible for the print wires combined with maximum efficiency, dependability and life.

A still further object of the present invention is to provide for a wire matrix print head assembly characterized by its versatility and conformability for use at different speeds in various different printing applications heretofore not considered feasible for matrix printers.

In accordance with the present invention, a wire matrix print head has been devised for dot or wire matrix printers in which the print wires are disposed and guided for movement in a generally conical, slotted wire guide body which converges forwardly into a hollow head and terminates in a bearing portion at its leading end, the bearing portion defining a series of vertically aligned closely spaced openings for reception of the leading ends of the print wires. The trailing ends of the print wires are mounted in electromagnetic actuators which are attached to the wire guide body so that the trailing ends form the corners of an unequal-sided polygon in an imaginary plane passing transversely of the direction of movement of the leading ends of the print wires into the print medium. The wire guide body is provided with arcuate, open slots for reception of the greater length of the print wires as they are caused to converge forwardly from the trailing ends through open support means formed in the hollow head and at each point along the length of the print wires between their attachment to the electromagnetic actuators and their passage through the open support in the head, the wires would form the corners of a polygon in an imaginary plane passing through the print wires transversely of or normal to their direction of movement into the print medium. The geometrical relationship between the print wires is a result of their extension in different radial directions away from their leading ends along equal radii of curvature and at equally displaced included angles between adjacent print wires. In this way, each print wire will respond in like manner in being driven forwardly by its electromagnetic actuator into the paper so as to assure that the leading ends will make even impressions or dots on the print medium.

Furthermore, in guiding the print wires along their elastic curves at equally displaced angles as described, minimal support or surface engagement for the print wires is required and an extremely compact mounting and arrangement of the actuators and pring wires is assured with minimal power requirements. Equally important, the deflection of the leading ends as they are driven into the print medium is materially reduced together with associated wear on the side surfaces of the print wires.

The above and other objects, advantages and features of the present invention will become more readily appreciated and understood from a consideration of the following detailed description of a preferred form when taken together with the accompanying drawings in which:

DESCRIPTION OF THE PREFERRED EMBODIMENT

Figure 1:
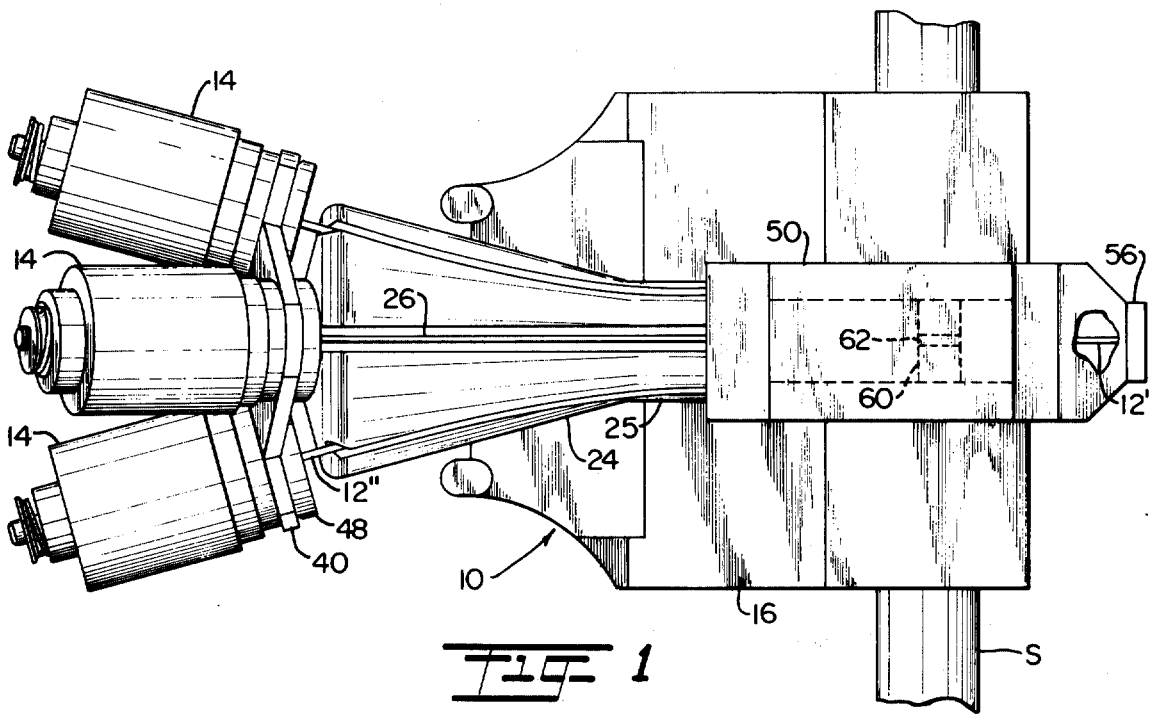
FIG. 1 is a top plan view of a preferred form of print head assembly in accordance with the present invention.
Figure 2:
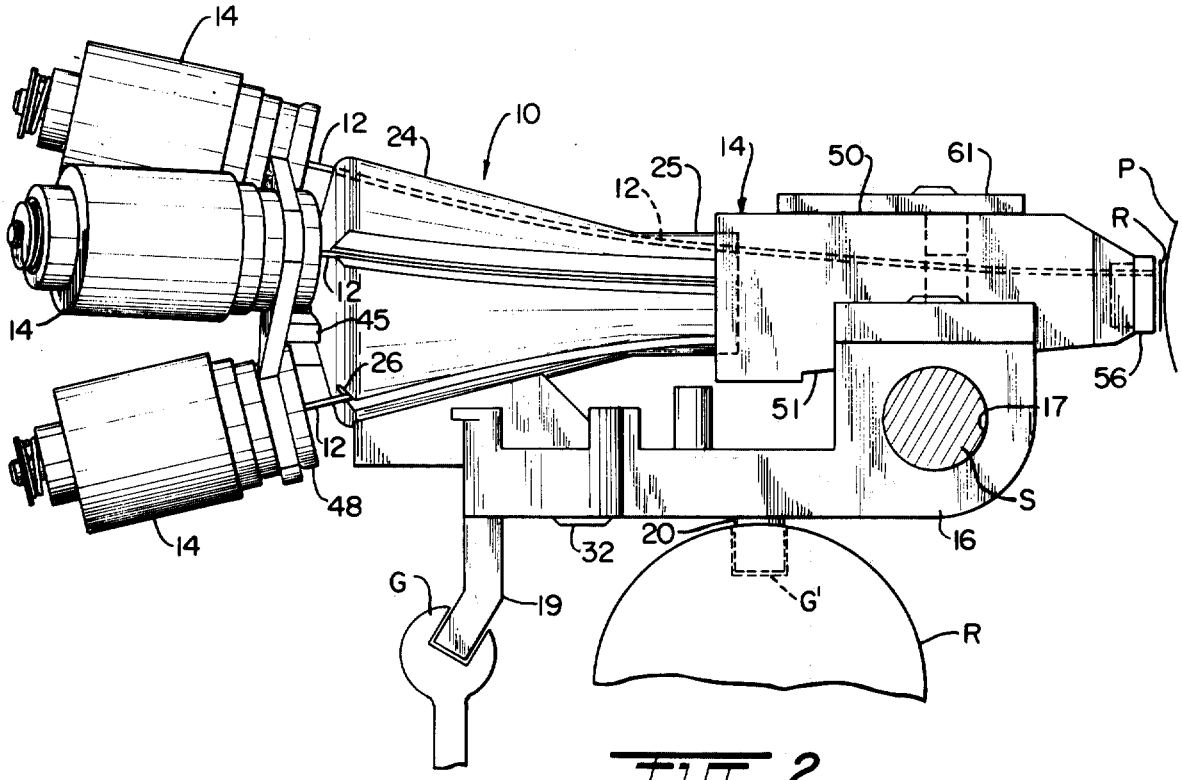
FIG. 2 is a side view in elevation of the assembly shown in FIG. 1.

Referring in more detail to the drawings, there is illustrated in FIGS. 1 and 2 a preferred form of print head assembly 10 which is adapted to be incorporated for use in various wire matrix printer applications, such as, for example, a calculator printer of the type set forth and described in my copending application, Ser. No. 527,603, filed 27 Nov., 1974 and entitled SERIAL IMPACT CALCULATOR PRINTER. The print head assembly 10 is broadly comprised of a plurality of print wires 12 arranged for extension through a wire guide assembly 24 the trailing end of each print wire 12 being mounted in one of the solenoid actuators 14 so that when one of the actuators 14 is energized it is operative to drive its associated print wire through the wire guide assembly forwardly to impress a print ribbon R against a record or print medium, such as, an endless roll of paper represented at P which is advanced and supported by a platen, not shown. The print head assembly as described may be suitably mounted for translational movement across the paper or other print medium in various ways; and in the preferred embodiment as shown, the assembly is mounted on a head carrier 16 which includes a bore 17 for insertion of support shaft S, a slide projection 19 which is adapted to be inserted into a groove represented at G in the frame of the printer apparatus, and a stud 20 which is adapted for insertion in the groove G' of a drive roller R.

As described in more detail in the hereinbefore-referred to copending application for patent, rotation of drive roller R will through the helical groove G' impart translational movement to the stud 20 on the head carrier so that the print head assembly is caused to advance laterally across each line of a page for printing characters or symbols thereon. In accordance with conventional practice, one or more selected print wires may be actuated at predetermined incremental positions as the print head assembly 10 is caused to advance across each line so that each character or symbol formed is comprised of a series of dots or impressions caused by driving of the print wires forwardly against the print medium. For the purpose of illustration, in the preferred form, five print wires 12 are provided with their leading ends arranged in a single column as hereinafter described although it will become apparent that the principles of the present invention would equally apply to other selected numbers of print wires and whether or not the leading ends are arranged in single or multiple columns or in other alignments as well.

Now considering in more detail the construction and arrangement of the wire guide assembly 14, a conical body 24 converges forwardly in a direction away from the solenoid actuators 14 to terminate in a forward, generally cylindrical terminal end 25. Open slots 26 are formed in the external surface of the conical body 24 at spaced circumferential intervals to extend the full length of the body and similarly to converge forwardly from the rearward end to the forward terminal end 25, as best seen from a consideration of FIGS. 1, 2 and 9 to 11. As seen, each slot 26 is of generally rectangular cross-section and has outwardly flared or beveled sides 28 which define an entrance into each slot, the slot itself generally conforming in width to the diameter or cross-sectional size of the print wire 12 seated therein. In addition, each slot varies in depth along its length, and each slot is of a slightly different depth to permit its respective print wire to be disposed to extend along its elastic curve, for example, as illustrated by the print wire 12 in FIG. 2. The wire guide body 24 preferably is affixed to the rearward end of the head carrier 16 by a downwardly projecting flange 30 which is affixed by a suitable fastener 32 to the body of the head carrier.

Figure 4:
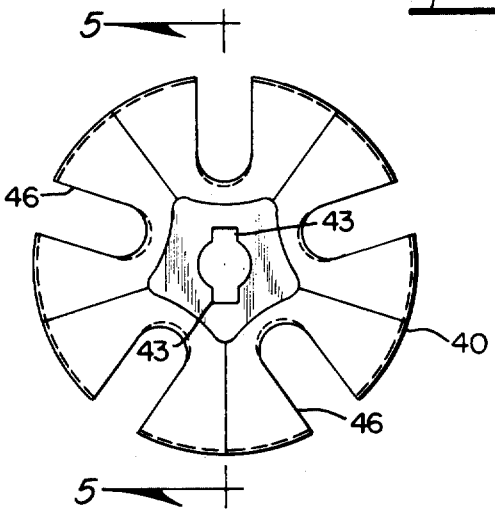
FIG. 4 is a detail end view of the retainer member for a plurality of solenoid actuators.
Figure 5:
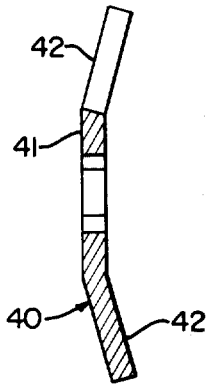
FIG. 5 is a cross-sectional view taken about lines 5—5 of FIG. 4.
Figure 6:
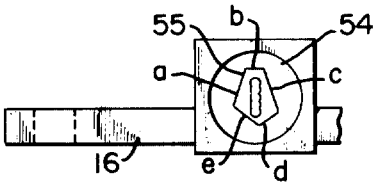
FIG. 6 is an enlarged view of the forward head portion of the print head assembly.
Figure 9:
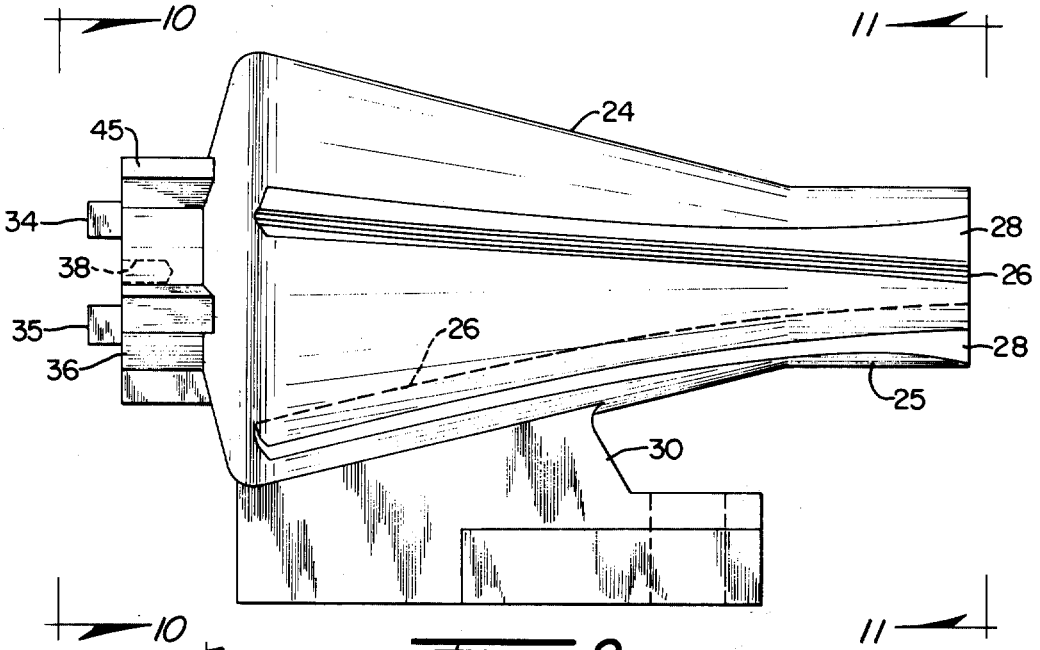
FIG. 9 is an enlarged view in more detail of the conical body of the wire guide.
Figure 10:
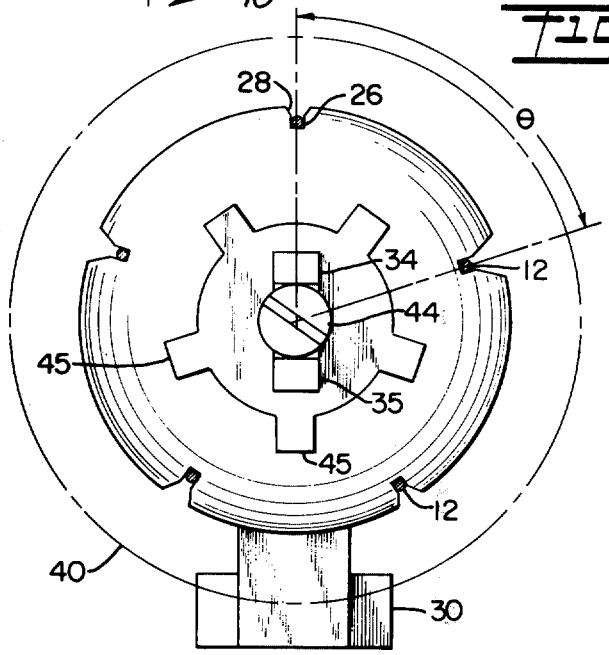
FIG. 10 is an end view from the rear end of the wire guide body shown in FIG. 9 with the retainer plate shown in FIG. 4.
Figure 11:
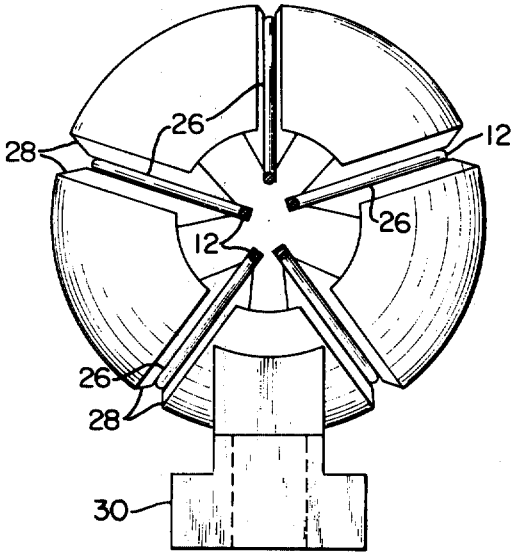
FIG. 11 is an end view of the opposite end of the wire guide body shown in FIG. 9.

In order to mount the solenoid actuators 14 in desired predetermined aligned relation to the guide slots 26, upper and lower spaced studs 34 and 35, as shown in FIG. 9, project rearwardly from mounting block 36 at the rearward end surface of the wire guide 24, the studs 34 and 35 being spaced symmetrically above and below a central threaded bore 38. A retainer plate 40, as shown in detail in FIGS. 4 and 5, includes a relatively flat central portion 41 and inclined outer circumferential retainer portions 42, the plate being connected to the mounting block 36 by insertion of the studs 34 and 35 into central keyways 43 and insertion of a fastening screw 44 through the keyway between the studs 34 and 35 and into threaded engagement with the bore 38 in the mounting block, as shown in FIG. 10. The mounting block additionally is provided with radially extending projections 45 at spaced circumferential intervals, and radial slots 46 are arranged at spaced circumferential intervals in the outer inclined portion 42 of the retainer plate so as to be located intermediately between the radial projections 45 when the retainer plate is properly aligned by the studs 34 and 35 and mounted in place on the mounting block by the screw 44. The radial slots 46 are each sized for insertion of the nose 48 of a solenoid actuator 14 with a central opening 49 in the nose which is adapted to receive the trailing end of a print wire 12 and is therefore coaxially aligned with the rearward direction of extension of each print wire 12 from its guide slot 26 in the wire guide body. Thus, in assembled relation, each solenoid actuator is aligned with a respective guide slot and specifically with a print wire extending rearwardly away from the slot so as to fix the trailing ends of the print wires in predetermined relation to the desired line or radius of curvature of the print wires through the respective guide slots 26 in a manner to be hereinafter described in more detail.

Figure 7:
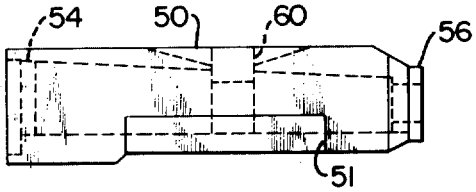
FIG. 7 is a view from the rearward end of the head portion shown in FIG. 6.
Figure 8:
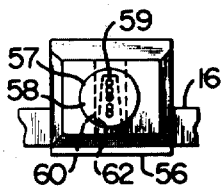
FIG. 8 is a front view of the opposite end of the head portion shown in FIG. 6.

The forward cylindrical end 25 of the wire guide 24 is inserted into a counterbore formed in the rearward end of a hollow generally rectangular head or barrel portion 50, as shown in FIGS. 7 to 9, the head 50 having an inset portion 51 on its lower surface seated on and positively affixed to the forward end of the head carrier 16. A rear wall or plate 54 is mounted across the rearward end of the hollow head directly in front of the forward terminal end 25 and includes a five-sided opening 55 therein which has five internal side surfaces designated *a*, *b*, *c*, *d* and *e*, inclusive, which are aligned along the desired path of extension of the print wire 12. In turn, the forward end of the head 50 includes a forwardly tapered nose portion 56 with a circular opening 57 communicating with the hollow interior of the head and adapted to receive a circular bearing plate 58 in which are formed a series of vertically aligned, horizontally extending, closely spaced openings 59 to receive leading ends 12' of the print wires 12. Furthermore, an alignment block 60 is suspended from a cover plate 61 for downward extension into the hollow interior of the head, the block 60 provided with a vertical slot 62 aligned with the openings 59 in the bearing plate whereby to support and pre-align the print wires 12 for forward extension from the plate 54 into the bearing plate 58. Specifically, the slot 62 causes the wires to converge into substantially parallel superimposed relation for continued horizontal extension through the openings 59.

Figure 3:
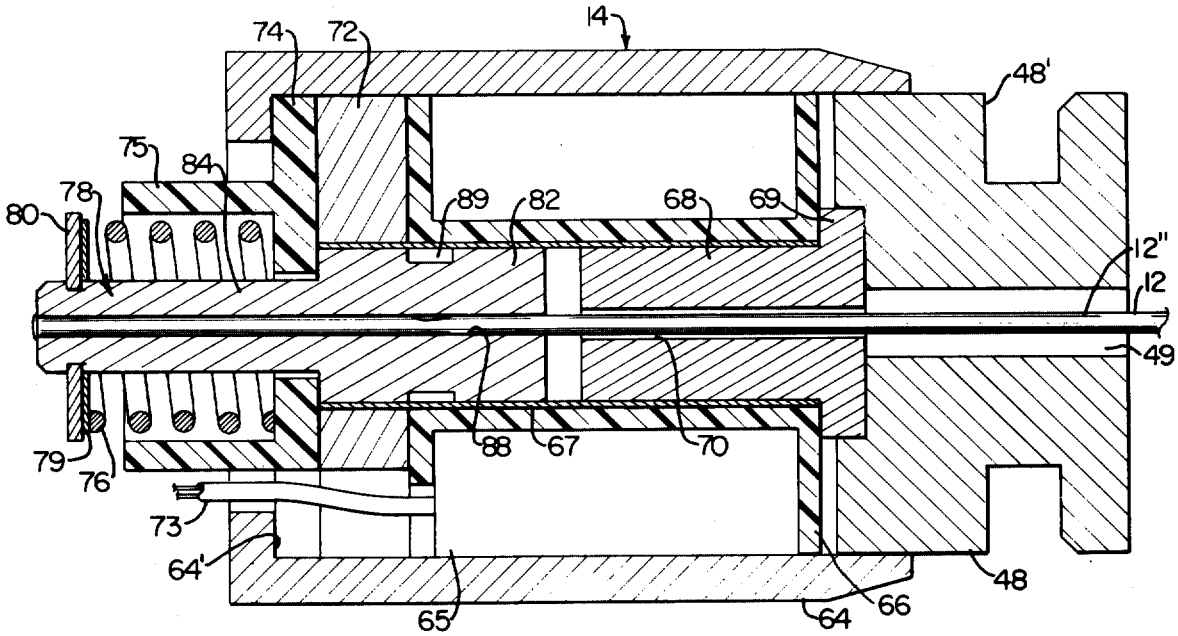
FIG. 3 is an enlarged vertical cross-section view of one of the solenoid actuators.

Referring to FIG. 3, a preferred form of one of the solenoid actuators 14 is illustrated. The actuator 14 as shown is seen to comprise an outer cylindrical housing 64 having the solid nose portion 48 inserted within the forward end of the housing and permanently affixed thereto. The nose has a circumferential groove 48' which is sized for insertion into one of the radial slots 46 on the retainer 40 as hereinbefore described with the central opening 49 aligned for insertion of the trailing end 12'' of the print wire 12. A drive coil 65 is wound upon a bobbin or spool 66 which is placed in surrounding relation to a thin-walled copper tube 67. A front pole piece 68 is inserted into one end of the tube 67 and has an enlarged circular flange 69 which is interposed between the nose 48 and the spool 66, and a central bore 70 in the pole piece 68 is aligned with, but of reduced size with respect to, the central opening 49 in the nose.

A second pole piece 72 is interposed between the spool 66 and end stop 74, the pole piece being of annular configuration and provided with an opening to permit rearward extension of lead wires 73 from the coil 65 to energize the coil from a suitable source of electricity, not shown. The end stop 74 is generally in the form of a plastic cup and has a rearwardly directed sleeve 75 which is sized to receive a return spring 76 in surrounding relation to armature 78, the latter provided with a washer 79 and another end step 80 to retain the return spring normally under compression between the stops 74 and 80. The sleeve 75 also prevents wire 73 from interfering with the spring 76, armature 78, washer 79, and end stop 80.

The armature 78 is provided with an enlarged cylindrical portion 82 inserted through the rearward end of the copper tube 67 and a reduced cylindrical stem portion 84 projecting rearwardly through a central opening in the end stop 74 and beyond the rearward end of the housing 64. In this relation, the rearward end of the housing includes an end wall 64' of limited extent to properly locate the elements as described between the end stop 74 and the front nose portion 48. The armature 78 is provided with a central bore 88 coaxially aligned with the central bore 70 in the pole piece 68 to receive the rearward extremity of the trailing end 12'' of the print wire 12. The forward cylindrical portion 82 of the armatutre includes an external circumferential groove 89 directly opposite to the rearward extremity of the print wire to facilitate its positive attachment of the print wire to the armature by bending the wall of the bore 88 and the rearward extremity of the wire, as shown, in a direction transversely of the length of the wire. This may be suitably accomplished prior to its assembly within the housing by striking the armature at a point on the surface of the groove 89 to cause the inner wall of the bore as well as the end 12'' of the wire 12 to be bent so as to prevent its accidental loosening or removal.

In assembled relation, the preferred form of print head assembly supports each print wire 12 so that its leading end 12' extends substantially along a straight line from the bearing plate 58 through the slot 62 in alignment block 60. Each wire then follows a curved line established by supporting it against a side surface of the opening 55, along the bottom of one of the slots 26 and affixing the outer trailing end 12'' in one of the actuators 14 which is coaxially aligned with the rearward end of the respective slot 26. The cooperative disposition and relation between each actuator 14, slot 26 and side surface of opening 55 is such as to locate each respective print wire 12 on its elastic curve, as a result of which the force to deflect the leading end 12' is held to a minimum. By minimizing the deflection force of the wire 12 the frictional engagement between the wire and its points of support is also held to a minimum, especially along the bearing plate 58.

Most desirably the print wires have their leading ends 12' in vertically aligned relation as described; and to most effectively mount the individual wires 12 in the manner described, each wire is caused to diverge rearwardly both with respect to a center line extending through the path of travel of its leading end and with respect to each adjacent wire so that for a given size of actuator sufficient clearance is afforded between the trailing ends of the print wires for disposition of the actuators in juxtaposed relation to one another at the least possible distance, or length, from the leading end of the print wires which is equally important in achieving minimal deflection of the leading ends of the print wires. When the leading ends 12' are arranged in column as shown in the preferred form it has been found that the foregoing conditions are best satisfied by extending the print wires rearwardly at equally displaced included angles with respect to adjacent wires. In other words, as represented in FIG. 10, that angle $\theta$ which is formed between the tangents to adjacent print wires at corresponding points along the lengths of the wires between the open support 55 and the actuators 14 are equal. Moreover, the print wires will form, in an imaginary plane passed through the print wires normal to their leading ends 12', the corners of an unequal-sided pentagon corresponding to the configuration of the open support 55 and progressively increasing in area rearwardly toward the trailing ends 12''.

It will be evident that the principles followed above may be readily applied to different numbers of print wires as well as to other leading end arrangements than the columnar arrangement as described. In each case however the length and deflection of the wires are held to a minimum while assuring that for a given driving force each wire will strike the print medium with an equal degree of force so as to assure formation of uniform dots or impressions. Still further, reduction of frictional pressure between the sides of the print wires and supporting surfaces, especially the bearing surfaces in the openings 59 will greatly minimize power requirement of the drivers or actuators for a desired striking force at the leading ends.

In its use and operation, the print head assembly is advanced laterally of the print medium in accordance with conventional practice and one or more actuators 14 are energized by energizing their drive coils 65 to simultaneously drive their actuators forwardly and cause the leading ends 12'' to force the print ribbon R against the print medium P. Preferably, the spacing of the print medium P in front of the leading ends 12' is less than the spacing between the armature 82 and front pole piece 68 so that the leading end 12' will strike the print medium before the armature 82 strikes the pole piece 68 in each forward stoke. Accordingly, when the coil 65 is deenergized the return spring 76 will cause the armature to be reversed and to pull the leading end of its associated print wire 12 rearwardly into the bearing plate 58 in preparation for the next print cycle.

Other advantages of the present invention, such as, simplified construction, compact arrangement and size of the print head will be readily apparent to those skilled in the art. It is further to be understood that while a preferred form only of the present invention has been set forth and described, various modifications and changes may be made therein without departing from the spirit and scope of the present invention as defined by the appended claims.

What is claimed is:

1. A wire matrix print head adapted for use with matrix printer apparatus comprising:

a plurality of elongated print wires having leading ends arranged in closely spaced relation to one another normal to and in confronting relation to a print medium, said print wires diverging away from said leading ends and from one another each along a predetermined corresponding path of curvature, a plurality of actuators, each actuator affixed to one of said print wires to drive its associated print wire forwardly toward the print medium, and to effect return of said print wire in a rearward direction away from the print medium, and guide wire means defining an elongated open polygonal support interposed between said actuators and the print medium to guide each of said print wires for rearward divergent extension in which at any given location along the substantial length of said print wires rearwardly of their leading ends said print wires are disposed at equally displaced included angles with respect to adjacent wires but at unequal distances apart to define the corners of a polygon having sides of unequal length in an imaginary plane passing through the print wires transversely of their leading ends, each of said print wires being unconfined along their substantial length and being guided by said guide wire means for advancement along a corresponding path of curvature as they are driven forwardly into the print medium.

2. A wire matrix print head according to claim 1, said guide wire means including a bearing member provided with a series of openings therein aligned in a common plane for insertion of a leading end of each print wire through an opening in a direction normal to the print medium.

3. A wire matrix print head according to claim 2, said guide wire means supporting each of said print wires for extension rearwardly from its leading to its trailing end along the elastic curve of each said print wire.

4. A wire matrix print head according to claim 3, said guide wire means including a generally conical body having open print wire-receiving slots extending at spaced intervals along the external surface of said body parallel to the central axis thereof, said slots varying in depth with respect to one another in order to conform to the elastic curve of each print wire in its extension rearwardly along said conical body.

5. A wire matrix print head according to claim 4, said guide wire means including a hollow head at the forward end of said conical body, and a bearing member disposed at the forward end of said hollow head.

6. A wire matrix print head according to claim 5, each of said wire-receiving slots being of generally rectangular cross section with outwardly flaring sides leading into said slot, each said slot having a width corresponding to the diameter of its respective print wire.

7. A wire matrix print head according to claim 1, said guide wire means including a conical body provided with radially outwardly opening wire-receiving slots therein, and a retainer plate on the larger end of said body provided with radial slots adapted for mounting of said electromagnetic actuators in coaxial alignment with the rearward ends of said wire-receiving slots.

8. A wire matrix print head assembly adapted for use with matrix printer apparatus in printing characters or symbols on a print medium, comprising:

a head carrier;

a wire guide assembly including a generally conical, forwardly convergent body having a forward, generally cylindrical terminal end, a plurality of open slots formed in the external surface of said conical body at spaced circumferential intervals to extend the full length of the body, and a hollow head defining a forward extension of the forward terminal end of said conical body including a multi-sided opening therein defining an open polygonal support having a plurality of internal sides and intersecting corners between the sides aligned with said open slots along the desired path of extension of a plurality of print wires, each wire extending through one of said slots, and a bearing plate spaced forwardly of said open polygonal support providing a series of vertically aligned, print wire-receiving openings, said bearing plate disposed adjacent and parallel to the print medium;

a plurality of elongated print wires each disposed for extension through an open slot in said conical body and through said hollow head, said print wires being unconfined along their substantial length, the leading ends of said print wires extending through the wire-receiving openings in said bearing plate, each of said print wires diverging in a different direction rearwardly away from its leading end along a predetermined path of curvature defined by the corners of said open polygonal support and said open slots and each terminating in a trailing end rearwardly of said open slots; and a plurality of actuating means mounted at the rearward end of said conical body, each of said actuating means provided with a central aperture to receive one of the trailing ends of said print wires whereby to fix the trailing ends of said print wires at equally displaced included angles with respect to one another and at equal angles of divergency away from their leading ends, said actuating means each being operative to selectively drive its respective print wire in a forward and return direction whereby to cause the leading end of said print wire to advance into engagement with said print medium to form an impression thereon.

9. A wire matrix print head assembly according to claim 8, said open polygonal support being disposed at one end of said head opposite to said bearing plate, and an alignment member including wire-receiving means located intermediately between said bearing plate and said open support to receive and guide said print wires into said bearing plate.

10. A wire matrix print head assembly according to claim 9, there being an odd number of print wires and a corresponding odd number of sides in said open polygonal support, each side being located a predetermined radial distance away from the point of entry of the associated print wire into its wire-receiving opening in said bearing plate to locate said print wire in its elastic curve.

11. A wire matrix print head assembly according to claim 8, the trailing ends of said print wires defining the corners of a polygon in an imaginary plane passing through the print wires in a direction transversely of the direction of extension of said leading ends of said print wires through said bearing plate.

12. A wire matrix print head assembly according to claim 8 including a retainer plate mounted on the rearward end of said conical body provided with radial slots at equal spaced circumferential intervals for mounting of said actuating means with their central apertures aligned with the desired path of extension of said print wires rearwardly away from the open slots of said conical body.

13. A wire matrix print head assembly according to claim 8, said open slots and open support cooperating to define a guide path for each print wire along the elastic curve of each print wire, the included angles between adjacent print wires being equal throughout their substantial length, the direction of extension of each print wire being in a different plane.

14. A wire matrix print head adapted for use with matrix printer apparatus comprising:

a plurality of elongated print wires having leading ends arranged in closely spaced relation to one another normal to and in confronting relation to a print medium, said print wires diverging away from said leading ends and from one another each along a predetermined corresponding path of curvature, said print wires defining the corners of a polygon in an imaginary plane passing through the print wires transversely of their leading ends at any given location along the substantial length of said print wires rearwardly of their leading ends, actuating means at the trailing ends of said print wires for driving said print wires forwardly into the print medium and rearwardly away from the print medium, and an elongated guide wire body interposed between said actuating means and the print medium including guide slot means in the form of radially outwardly opening guide wire slots located at spaced circumferential intervals on the external surface of said guide wire body and at unequal distances from the longitudinal axis of said body to receive said print wires and guide them in their predetermined path of curvature as they are driven forwardly into the print medium.

15. A wire matrix print head according to claim 14, said guide wire body including a bearing member provided with vertically aligned openings therein for insertion of a leading end of each print wire through each opening in a direction normal to the print medium.

16. A wire matrix print head according to claim 15, said guide means supporting each of said print wires for extension rearwardly from its leading to its trailing end along the elastic curve of each said print wire, said print wires disposed therealong at equally displaced included angles to one another.

17. A wire matrix print head according to claim 15, said guide wire body including a generally conical body having said open print wire-receiving slots extending at circumferential intervals along the external surface of said body, said slots being of varying depth along their length and with respect to one another in order to conform to the elastic curve of each print wire in its extension rearwardly along said conical body.

18. A wire matrix print head adapted for use with matrix printer apparatus comprising:

a plurality of elongated print wires having leading ends arranged in closely spaced relation to one another normal to and in confronting relation to a print medium, said print wires diverging away from said leading ends and from one another each along a predetermined corresponding path of curvature, a plurality of actuators, each actuator affixed to one of said print wires to drive its associated print wire forwardly toward the print medium and to effect return of said print wire in a rearward direction away from the print medium, and guide wire means interposed between said actuators and the print medium to guide each of said print wires for rearward divergent extension in which at any given location along the substantial length of said print wires rearwardly of their leading ends said print wires are disposed at equally displaced included angles with respect to adjacent wires but at unequal distances apart to define the corners of a polygon having sides of unequal length in an imaginary plane passing through the print wires transversely of their leading ends, each of said print wires being guided by said guide wire means for advancement along a corresponding path of curvature as they are driven forwardly into the print medium, said guide wire means including a bearing member provided with a series of openings therein aligned in a common plane for insertion of a leading end of each print wire through an opening in a direction normal to the print medium and an open support rearwardly of said bearing member defining a polygonal shaped opening having a plurality of side surfaces corresponding to the number of wires, the side surfaces of said opening supporting said print wires for rearward divergent extension at the corners formed at the intersections of the side surfaces along equally displaced included angles away from the leading end of each respective print wire.

* * * * *